US006541724B2

(12) United States Patent
Nozawa et al.

(10) Patent No.: US 6,541,724 B2
(45) Date of Patent: Apr. 1, 2003

(54) KEY SWITCH

(75) Inventors: Yuichiro Nozawa, Gunma Pref. (JP); Zenzo Tozuka, Gunma Pref. (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/150,959

(22) Filed: May 21, 2002

(65) Prior Publication Data

US 2002/0179423 A1 Dec. 5, 2002

(30) Foreign Application Priority Data

May 23, 2001 (JP) ..... 2001-153877

(51) Int. Cl.[7] ..... H01H 13/70
(52) U.S. Cl. ..... 200/517; 200/512

(58) Field of Search ..... 200/5 A, 512, 200/517, 341, 344, 345

(56) References Cited

U.S. PATENT DOCUMENTS 5,298,706 A * 3/1994 English et al. ..... 200/517
6,121,563 A * 9/2000 Hochgesang et al. ..... 200/343
6,204,462 B1 * 3/2001 Huang ..... 200/345
6,355,894 B2 * 3/2002 Miyakoshi ..... 200/344

* cited by examiner

*Primary Examiner*—Michael Friedhofer
(74) *Attorney, Agent, or Firm*—Junichi Mimura

(57) ABSTRACT

A key switch includes an elastic member having a circular open end and a membrane sheet on which the elastic member is disposed. The membrane sheet includes two flexible sheets and an insulating resin sheet sandwiched between them. The insulating sheet includes an opening, which has a shape different from that of the open end.

14 Claims, 9 Drawing Sheets

KEY SWITCH

CROSS-REFERENCE TO RELATED APPLICATION

This application claims the priority benefit of Japanese Patent Application No. 2001-153877, filed May 23, 2001, the entire disclosure of which is incorporated herein by reference.

BACKGROUND OF THE INVENTION

1. Field of the Invention

This invention relates to a key switch capable of use in a keyboard, specifically to a structure of the key switch.

2. Description of the Related Art

In the related art, many key switches are disposed on a keyboard, which is used in computer system, subject to specific rules. Each of the key switches includes a key top on which a letter is printed, an elastic member made of a rubber material, a membrane contact sheet and a base plate. The elastic member includes a bell-shaped spring leg part, an upper part and a contact depression part. One end of the bell-shaped spring leg part is opened, and the other end is connected to the upper part. The contact depression part is formed at a center in the internal surface of the bell-shaped spring leg part. The key top is formed on the upper part of the elastic member. The elastic member is disposed on the membrane contact sheet in contacting its open end to the membrane contact sheet.

The membrane contact sheet includes a pair of flexible sheets (upper and lower flexible sheets), which face each other, and an insulating resin sheet, which is sandwiched between the flexible sheets. The lower flexible sheet is formed on the base plate and the upper flexible sheet contacts the open end of the elastic member. The insulating resin sheet includes an opening, which is concentric with the open end of the elastic member. By forming the opening, a room is defined between the flexible sheets. Each of the flexible sheets has a contacting pad, which is located in the opening, and the contacting pads formed on the respective flexible sheets face each other. Each of the contacting pads is connected to a conductive wire, which is formed on each flexible sheet. The conductive wire is formed of conductive ink made of silver, carbon and other materials, and is printed on the flexible sheet. The conductive wire has a width of about 0.5 mm and a height of about 10 $\mu$m.

According to this structure, when the key top, in an original position, is pushed down, the bell-shaped spring leg part is deformed so that the key top is moved down so that the contact depression part contacts the upper flexible sheet. When the key top is pushed further down, the upper flexible sheet is deformed toward the lower flexible sheet. Since the contact depression part contacts the upper flexible sheet in an area where the contacting pad is formed, the contact pads formed on the respective flexible sheets contact each other when the key top is pushed down further. In this state, the key switch is closed. When the key top is released, the key top returns to the original position by the memory of the elastic member, and the upper flexible sheet returns to its original shape by its memory. As a result, the contacting pads are separated so that the key switch is opened.

Two ways to satisfy a requirement for downsizing a keyboard having the structure described above include: (1) narrowing an interval between the key switches, (2) reducing the size of the key switch itself. However, narrowing the interval has the problem that there is a definite limit to narrowing an interval between the key switches. This is because it is necessary to secure a space for printing the conductive wire.

Reducing the size of the key switch has the following problem. The diameters of the open end of the bell-shaped spring leg part and the opening of the insulating resin sheet must be reduced. Here, the diameter of the open end of the bell-shaped spring leg part is often larger than that of the opening of the insulating resin sheet. Thus, the bell-shaped spring leg part is supported by the insulating resin sheet.

Further, in a case that the diameter of the opening of the insulating resin sheet is about 3.5 mm, it is required to push the key top with a force in the range between 7 gf and 9 gf in order to make the contact pads contact. In another case, where the diameter of the opening of the insulating resin sheet is about 3.0 mm, it is required to push the key top with a force in the range between 13 gf and 15 gf in order to make the contact pads contact. Accordingly, the smaller the diameter of the opening is, the larger the required power is.

On the other hand, when the internal diameter of the bell-shaped spring leg part is reduced without reducing the length of the diameter of the opening, in other words, when the external diameter of the bell-shaped spring leg part equals or is less than the diameter of the opening of the insulating resin sheet, the force for pushing the key top down is applied to the upper flexible sheet on the opening via the bell-shaped spring leg part. Thus, the upper flexible sheet is deformed easily by less force so that the contact pads sometimes unintentionally contact each other.

Accordingly, in the related arts, to avoid these problems, the open end of the bell-shaped spring leg part is placed above the insulating resin sheet so that a relatively large elastic member is formed. This makes it difficult to downsize the key switches.

Further, it is preferable that a center of the contact depression part is brought into line with a center of each contact pad. If these are misaligned, the force for pushing the key top down to contact the contact pads varies. For example, if the diameter of the opening is about 3.5 mm, when the center of the contact depression part is misaligned with the center of each contact pad by 0.5 mm, it is required to push the key top with a force in the range between 8 gf and 12 gf in order to make the contact pads contact. In another case where the diameter of the opening is about 3.0 mm, when the center of the contact depression part is misaligned with the center of each contact pad by 0.5 mm, it is required to push the key top with a force in the range between 14 gf and 18 gf in order to make the contact pads contact.

As described above, compared to a key switch having no misalignment between the center of the contact depression part and the center of each contact pad, when the center of the contact depression part is misaligned with the center of each contact pad because of a misprint of the insulating resin sheet or misassembly of the elastic member, a larger force is required to push the key top down. Thus, when the key top is pushed with the intent to push the key switch having no misalignment, the contact pads may not contact each other because of the lack of the force.

SUMMARY OF THE INVENTION

It is therefore an object of the invention to resolve the above-described problem in a key switch and provide a downsized key switch.

It is another object to provide a key switch, which is operated by the constant force.

It is yet another object to provide a key switch, which is operated by the stable force.

It is still another object to provide a key switch, which is lax in accuracy of its assembling.

The object is achieved by a key switch including a key top, an elastic member, a first flexible sheet, a moveable contact pad, a second flexible sheet, a fixed contact pad, a insulating resin sheet. The elastic member includes a top part disposed under the key top, a bell-shaped spring leg having a circular open end, and a contact depression part located inside the bell-shaped spring leg. The first flexible sheet includes a top surface and a back surface, and the elastic member is placed on the top surface. The moveable contact pad is formed on the back surface of the first flexible sheet, and the moveable contact pad is located at the center of the open end of the bell-shaped spring leg. The fixed contact pad is formed on the second flexible sheet, and faces the moveable contact pad. The insulating resin sheet is sandwiched between the first and second flexible sheets, and the insulating resin sheet includes an opening, which has a shape different from that of the circular open end of the bell-shaped spring leg. The shortest distance between the center of the opening and the periphery of the opening is shorter than a half of the inside diameter of the circular open end. The longest distance between the center of the opening and the periphery of the opening is longer than the half of the inside diameter of the circular open end.

The above and further objects and novel features of the invention will more fully appear from the following detailed description, appended claims and accompanying drawings.

DETAILED DESCRIPTION OF THE PREFERRED EMBODIMENTS

In the first and second embodiments, the same reference numbers designate the same or similar components.

First Preferred Embodiment

Figure 1:
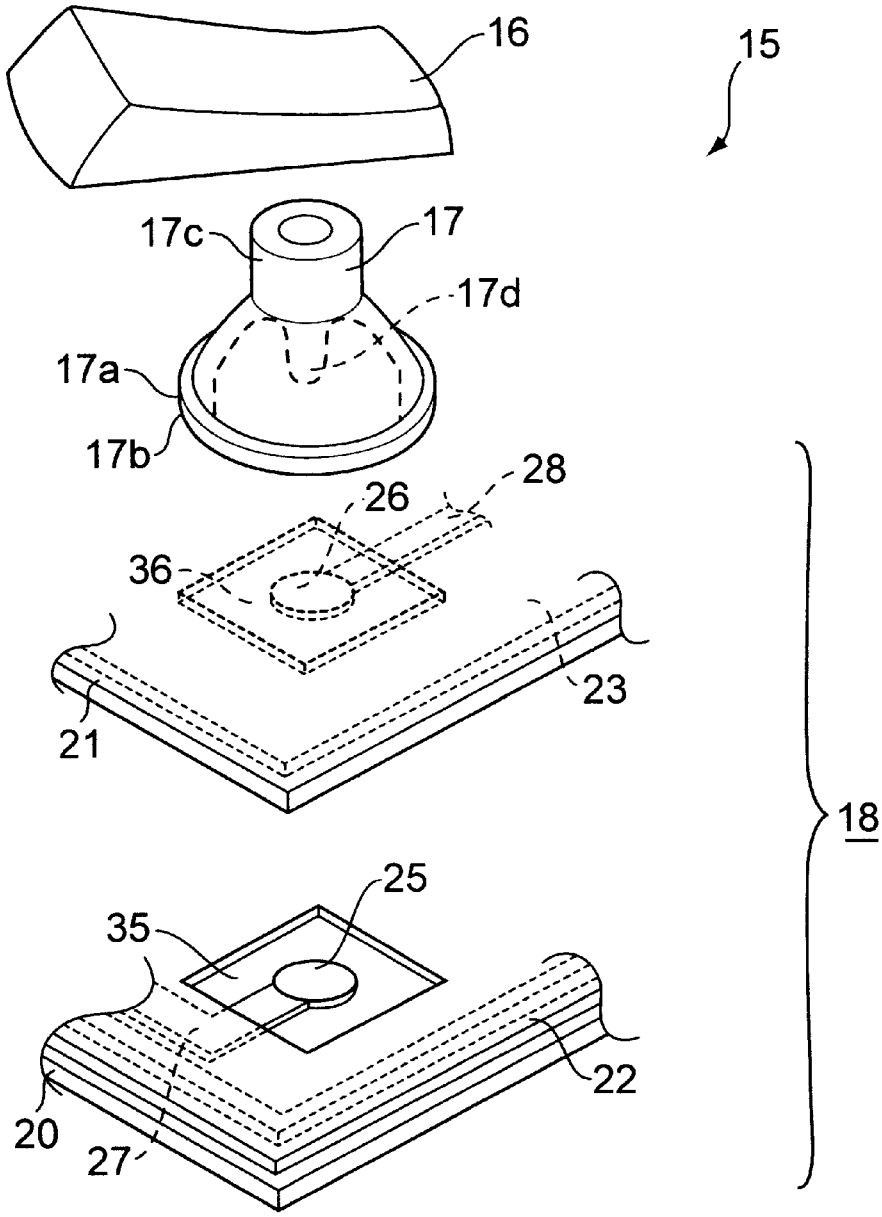
FIG. 1 is an exploded perspective view of a key switch according to a first embodiment of the invention.
Figure 2:
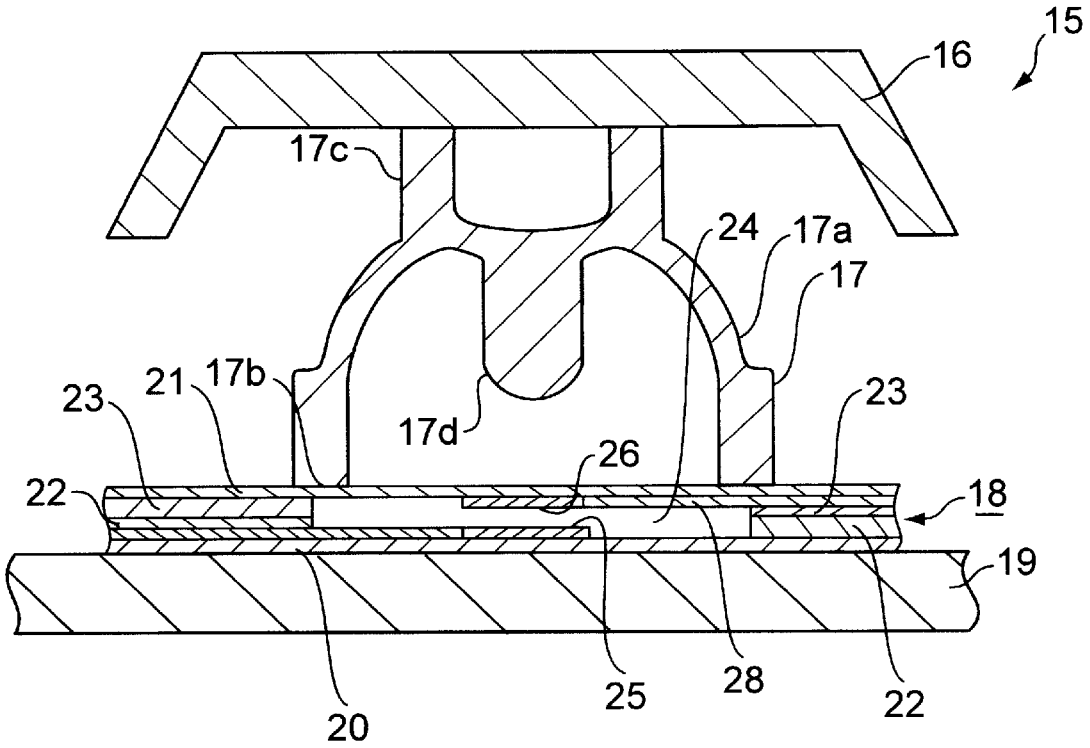
FIG. 2 is a cross-sectional view of the key switch of the first embodiment.

Referring to FIGS. 1 and 2, a key switch 15 includes a key top 16 on which a letter, such as an alphabet is printed, an elastic member 17 made of a rubber material, a membrane contact sheet 18 and a base plate 19. The elastic member 17 includes a bell-shaped spring leg part 17*a*, an upper part 17*c* and a contact depression part 17*d*. The bell-shaped spring leg part 17*a* includes a relatively thin part at its upper region and a relatively thick part at its lower region. One end 17*b* of the bell-shaped spring leg part 17*a* is opened, and the other end is connected to the upper part 17*c*. The contact depression part 17*d* is formed at a center in the internal surface of the bell-shaped spring leg part 17*a*. The key top 16 is disposed on the upper part 17*c* of the elastic member 17. The circular open end 17*b* of the elastic member 17 is disposed on the membrane contact sheet 18 by contacting the circular open end 17*b* to the membrane contact sheet 18.

The membrane contact sheet 18 includes a pair of flexible sheets (upper and lower flexible sheets) 21, 20, which face each other, and two insulating resin sheets 23, 22, which are sandwiched between the flexible sheets 21, 20. The lower flexible sheet 20 is formed on the base plate 19 and the upper flexible sheet 21 contacts the circular open end 17*b* of the elastic member 17. The upper insulating resin sheet 23, which is fixed on the upper flexible sheet 21, has a first opening 36. The lower insulating resin sheet 22, which is fixed on the lower flexible sheet 20, has a second opening 35. The first and second opening 36, 35 are square-shaped, and are the same size. The centers of the first and second openings are located coaxially. Thus, a room 24 is formed by the first and second square opening 36, 35. Each of the insulating resin sheets 23, 22 is an elastic sheet, and is formed on each flexible sheet by printing an insulating material having a width of about 20 $\mu$m.

In the center of the second square opening 35, a fixed contact pad 25 is formed on the lower flexible sheet 20. The fixed contact pad 25 is connected to a lower conductive wire 27, which is formed on the lower flexible sheet 20. The lower conductive wire 27 is formed of conductive ink made of silver, carbon and other materials, and is printed on the lower flexible sheet 20. The lower conductive wire 27 has a width of about 0.5 mm and a height of about 10 $\mu$m. In the center of the first square opening 36, a moveable contact pad 26 is formed on the upper flexible sheet 21. The moveable contact pad 26 is connected to an upper conductive wire 28, which is formed on the upper flexible sheet 21. The upper conductive wire 28 is formed of conductive ink made of silver, carbon and other materials, and is printed on the upper flexible sheet 21. The upper conductive wire 28 has a width of about 0.5 mm and a height of about 10 $\mu$m. The fixed contact pad 25 faces the moveable contact pad 26. The lower conductive wire 27 is sandwiched between the lower flexible sheet 20 and the lower insulating resin sheet 22, and the upper conductive wire 28 is sandwiched between the upper flexible sheet 21 and the upper insulating resin sheet 23. The lower flexible sheet 20 is fixed on the base plate 19.

Figure 3:
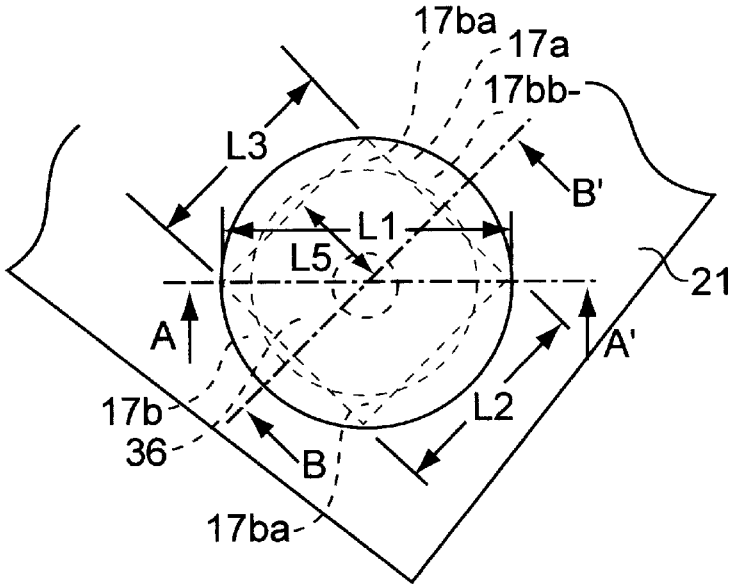
FIG. 3 is a partial plan view of the key switch of the first embodiment.
Figure 4:
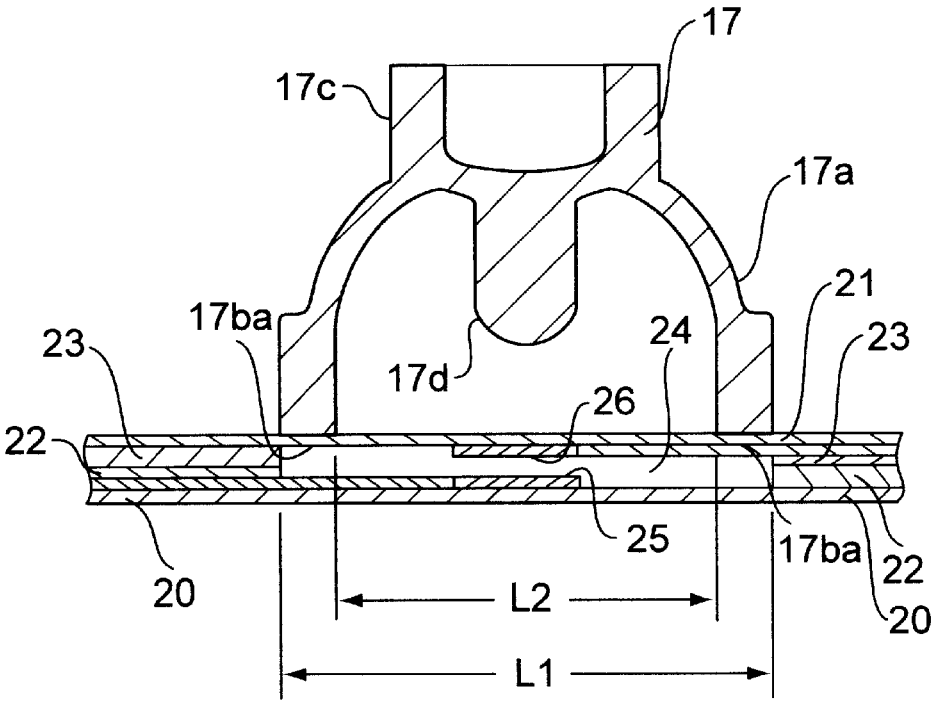
FIG. 4 is a cross-sectional view taken along line A—A' of FIG. 3.
Figure 5:
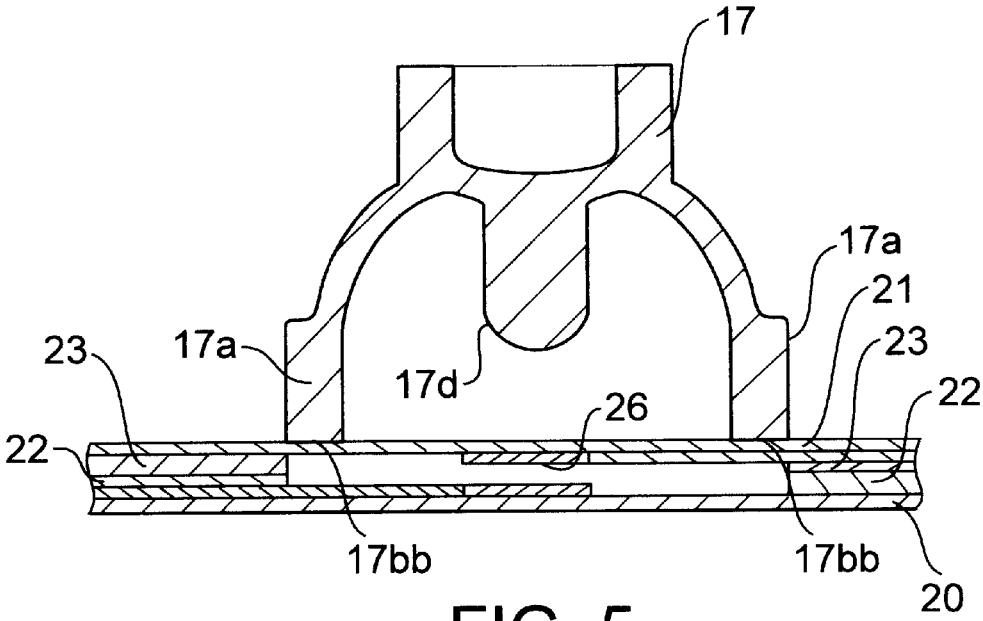
FIG. 5 is a cross-sectional view taken along line B—B' of FIG. 3.

Referring to FIG. 3, the relationship between the circular open end 17*b* of the elastic member 17 and the first square opening 36 is illustrated. A diagonal length L1 of the first square opening 36 is longer than the internal diameter L2 of the circular open end 17*b* (L1>L2). The side length L3 of the first square opening 36 is shorter than the internal diameter L2 of the circular open end 17*b* (L2>L3). Therefore, as shown in FIGS. 3 and 4, the elastic member 17 is not supported by the insulating resin sheets 22, 23 in an area 17*ba* adjacent to each corner of the first square opening 36. In other words, the insulating resin sheets 22, 23 do not exist under the elastic member 17 in the area 17*ba*. Further, as shown in FIGS. 3 and 5, the elastic member 17 is supported by the insulating resin sheets 22, 23 in the other area 17*bb* under the circular open end 17*b*.

As described above, the key top 16 is disposed on the upper part 17*c* of the elastic member 17. The circular open end 17*b* of the elastic member 17 is disposed on the upper flexible sheet 21 of the membrane contact sheet 18 by contacting the circular open end 17*b* to the upper flexible sheet 21. As shown in FIGS. 4 and 5, the elastic member 17 holds the key top 16 in the predetermined original position. As described above, the contact depression part 17*d* of the elastic member 17 is projected from the internal surface of the bell-shaped spring leg part 17*a* at its center, and the center of the contact depression part 17*d* is brought into line with the center of each of the moveable and fixed contact pads 26, 25. When the key top 16 in the original position is pushed down, the bell-shaped spring leg part 17*b* is deformed so that the key top 16 is moved down. Then, the contact depression part 17*d* contacts the upper flexible sheet 21. When the key top 16 is further pushed down, the upper flexible sheet 21 is deformed toward the lower flexible sheet 20. Since the contact depression part 17*d* contacts the upper flexible sheet 21 in an area where the moveable contacting pad 26 is formed, the moveable and fixed contact pads 26, 25 are contacted to each other when the key top is push down further.

Figure 6:
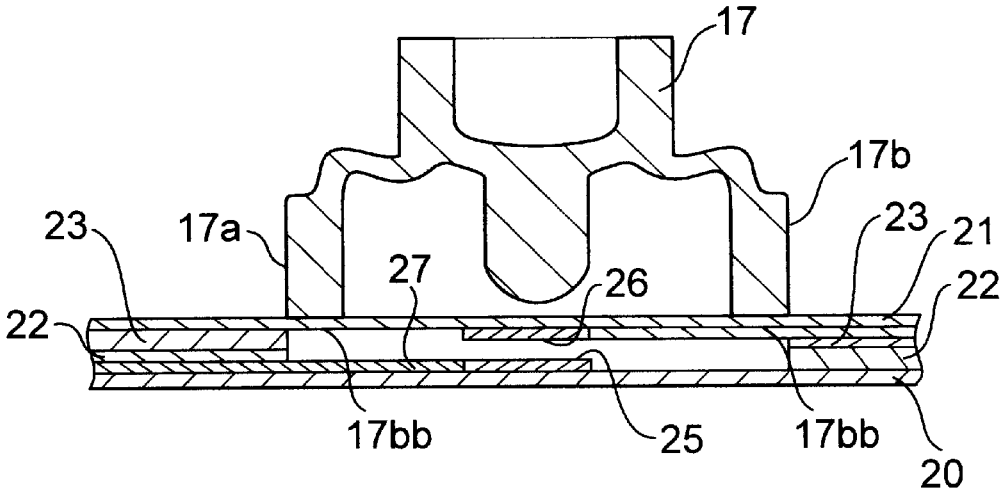
FIG. 6 is a cross-sectional view taken along line A—A' of FIG. 3, which shows process of operation of the key switch of the first embodiment.
Figure 7:
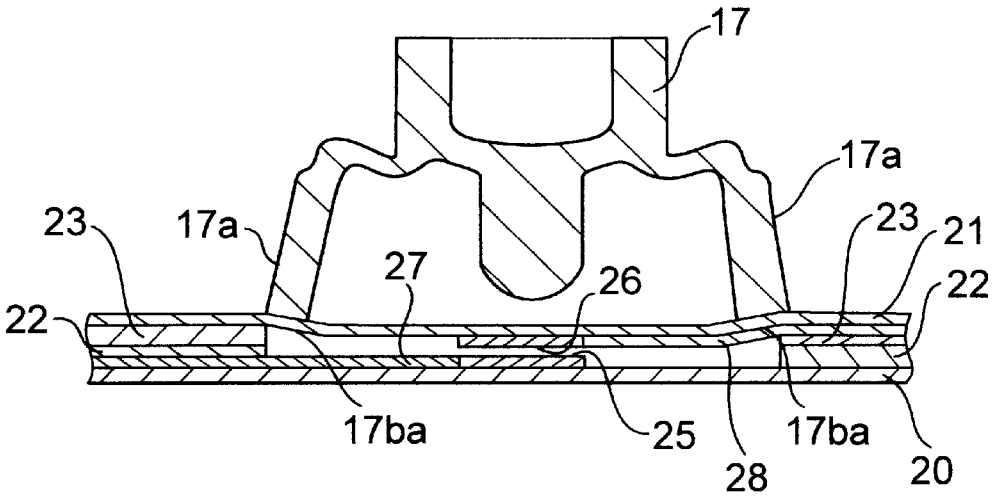
FIG. 7 is a cross-sectional view taken along line B—B' of FIG. 3, which shows process of operation of the key switch of the first embodiment.

Next, the detail key switch operation is explained with reference to FIGS. 6 and 7. When the key top 16 of the key switch 15 shown in FIG. 2 is pushed down by the operator, the relatively thin part of the bell-shaped spring leg part 17*a* begins to deform. As shown in FIG. 6, since the area 17*bb* of the circular open end 17*b* is supported by the upper and lower insulating resin sheets 23, 22, the upper flexible sheet 21 facing the area 17*bb* is not deformed. On the other hand, as shown in FIG. 7, since the area 17*ba* of the circular open end 17*b* is not supported by the upper and lower insulating resin sheets 23, 22, the upper flexible sheet 21 facing the area 17*ba* is also deformed in this area. When the key top 16 of the key switch 15 is further pushed down by the operator, the relatively thin part of the bell-shaped spring leg part 17*a* and the upper flexible sheet 21 are further deformed. As a result, the top of the contact depression part 17*d* reaches the upper flexible sheet 21. Then, when the contact depression part 17*d* pushes the upper flexible sheet 21 further, the moveable contact pad 26 reaches the fixed contact pad 25 so that the moveable contact pad 26 is electrically connected to the fixed contact pad 25. As a result, the key switch 15 is closed. When the key top 16 is released, the key top 16 returns to the original position by the memory of the elastic member 17, and the upper flexible sheet 21 returns to the original shape by its memory. As a result, the contacting pads 25, 26 are separated so that the key switch 15 is opened.

When the key top 16 is being pushed down, the bell-shaped spring leg part 17*a*is not inserted as a whole into the room 24 defined by the first and second square openings 36, 35 because the rubber cup 17 is supported by the upper and lower insulating resin sheets 23, 22 in the area 17*bb*.

According to the key switch of the first embodiment, since the shape of the open end 17*b* of the elastic member 17 is different from that of the first and second square openings 36, 35, the elastic member 17 is not supported by the insulating resin sheets 22, 23 in some areas. As a result, the upper flexible sheet 21 is deformed in parts by the bell-shaped spring leg part 17*a*. Thus, it is possible to reduce the force to push the key top down in order to make the contacting pads 25, 26 contact. As a result, if the insulating resin sheets 22, 23 are unintentionally misaligned to each other at printing, or if the center of the rubber cup is unintentionally misalinged to the center of the contact pads 25, 26 at assembly, it is not required to push the key top 16 down with a large force in order to bring the contact pads 25, 26 into contact. Thus, it is not necessary to form a marginal opening in anticipation of a printing misalignment of the insulating resin sheets 22, 23 or of the assembling misalignment of the elastic member 17. Accordingly, the distance from the side of the first or second square opening 35 or 36 to the center of the contact pad 25 or 26 can be shorter than the radius of the conventional circular opening. As a result, the upper and lower conductive wires 28, 27 can be disposed contiguously with the moveable and fixed contact pads 26, 25 so that it is possible to downsize the key switch 15 having the upper and lower conductive wires 28, 27.

Further, as described above, when the center of the key top 16 is misaligned to the center of the contact pads 25, 26 because of a misprinting of the insulating resin sheets 22, 23 or misassembly of the elastic member 17, it is not required to push the key top 16 down with a large force in order to make the contact pads 25, 26 contact each other. Thus, it is possible to form the key switch having less contacting defect without high-precision manufacturing processes. As a result, it is possible to reduce the cost of a mold for manufacturing the key switch.

Figure 8:
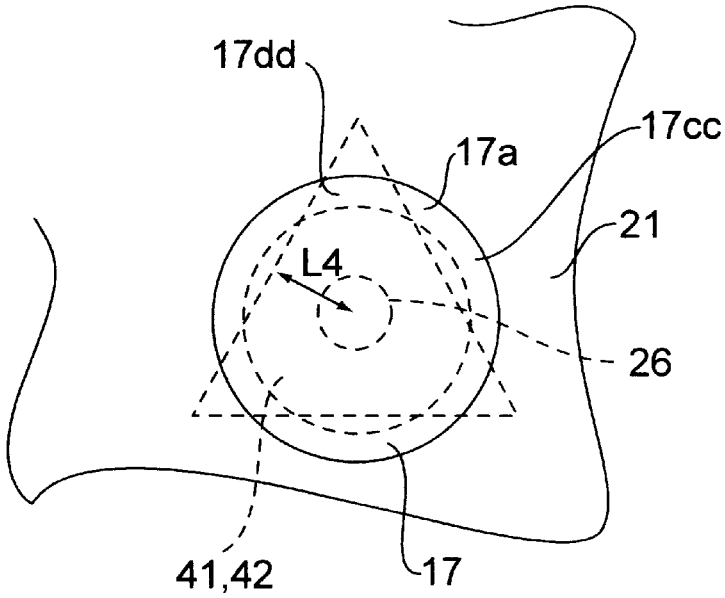
FIG. 8 is a partial plan view of a key switch according to an alternative of the first embodiment, in which an opening is triangular.

Although the first and second square opening 35, 36 are used in the first embodiment, other shapes of the opening are acceptable as well. Referring to FIG. 8, upper and lower equilateral triangle openings 41, 42 are illustrated. In this alternative embodiment, the shortest distance from the center to a side of the equilateral triangle opening 41 or 42 is the same as the distance from the side of the first or second square opening 35 or 36 to the center of the contact pad 25 or 26 shown in FIG. 3. In FIG. 8, the open end 17*a* of the elastic member 17 is supported by the insulating resin sheet at an area 17*cc*, and is not supported by the insulating resin sheet at an area 17*dd*. Therefore, when the size of the area 17*dd* of FIG. 8 equals the size of the area 17*ba* in FIG. 3, the force to push the key top 16 can be the same in the first embodiment and the alternative.

Moreover, other shapes of the opening, such as a pentagon or a hexagon, may be formed. Further, when the open end 17*b* of the spring leg part 17*a* is not circular, the circular opening may be formed. However, considering the positions of the conductive wires, the square-shaped opening is preferable.

Therefore, the important factors to embody the invention are:

(1) the first opening and the second opening should be the same shape and the same size (if there are two insulating resin sheets between the flexible sheets), (2) the shapes of the openings of the insulating resin sheets should be different from the shape of the open end 17*b* of the spring leg part 17*a*

(3) some parts of the open end 17*b* of the spring leg part 17*a* should be supported by the insulating resin sheet (s), while other parts are not.

Second Preferred Embodiment

Figure 9:
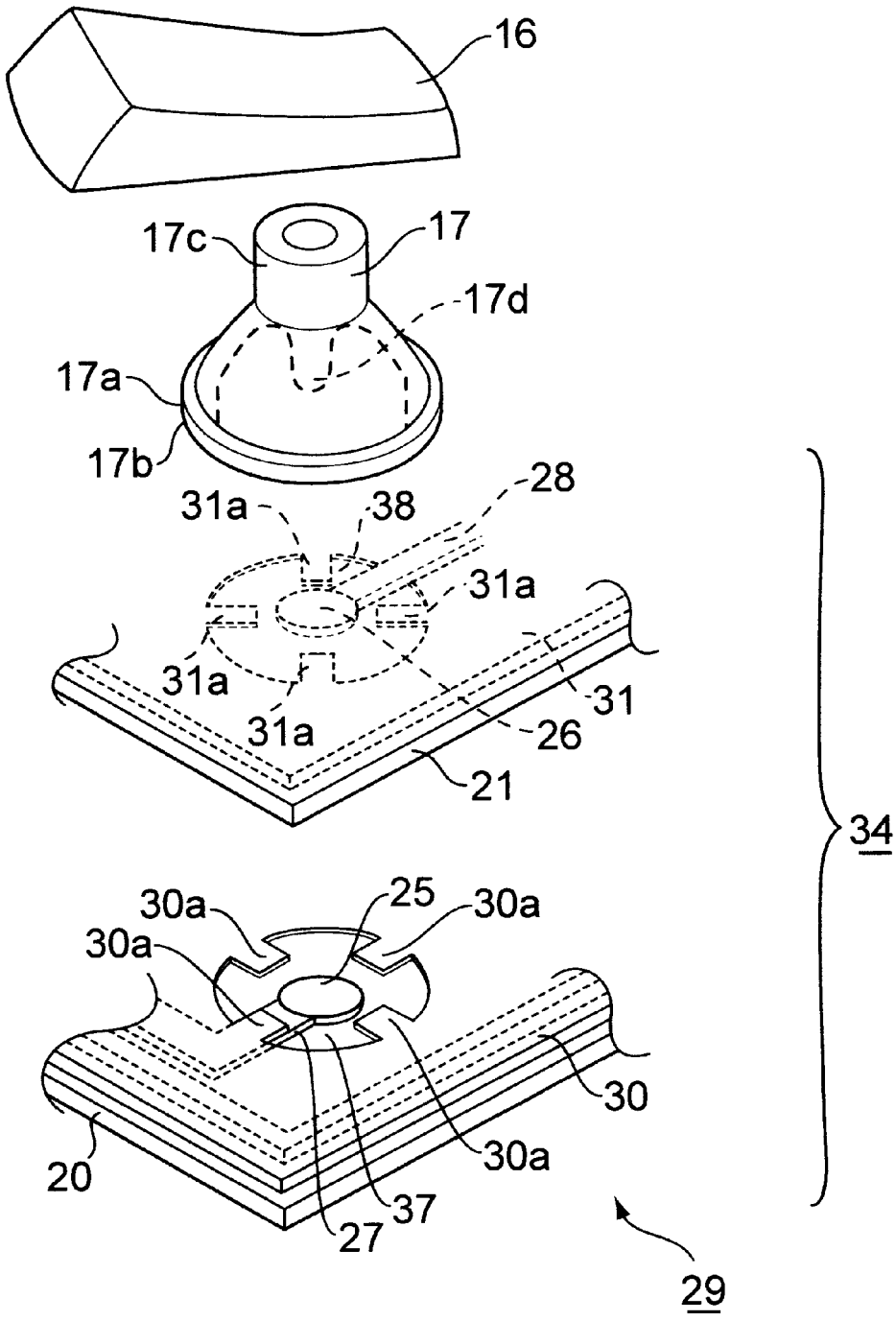
FIG. 9 is an exploded perspective view of a key switch according to a second embodiment of the invention.

Comparing to the first embodiment, the differences are the shape of the first opening and the second opening. Therefore, the following explanation is focused on the shapes of them. Referring to FIG. 9, a key switche 29 includes a key top 16 on which a letter, such as an alphabet is printed, an elastic member 17 made of a rubber material, a membrane contact sheet 34 and a base plate (unillustrated). The membrane contact sheet 34 includes a pair of flexible sheets (upper and lower flexible sheets) 21, 20, which face each other, and two insulating resin sheets 31, 30, which are sandwiched between the flexible sheets 21, 20. The lower flexible sheet 20 is formed on the base plate and the upper flexible sheet 21 contacts the circular open end 17*b* of the elastic member 17. The upper insulating resin sheet 31, which is fixed on the upper flexible sheet 21, includes a first opening 38. The lower insulating resin sheet 30, which is fixed on the lower flexible sheet 20, includes a second opening 37.

As illustrated in FIG. 9, the first opening 38 is circle-shaped. A moveable contact pad 26 is disposed in the center of the first opening 38. Four first extending parts 31*a* of the upper insulating resin sheet 31 project toward the moveable contact pad 26 in the first opening 38. Each of the first extending parts 31*a* is disposed in a diagonal line. That is, analogizing the layout of the four first extending parts 31*a* to a watch, they are disposed at 12AM, 3AM, 6AM, 9AM. Each of the four first extending parts 31*a* has a certain width, and each of the four first extending parts 31*a* has the same width. Each of the four first extending parts 31*a* is printed on the upper flexible sheet 21. The material of each first extending part 31*a* is the same as that of the upper insulating resin sheet 31. Thus, each first extending part 31*a* and the upper insulating resin sheet 31 are printed on the upper flexible sheet 21 simultaneously.

Further, as illustrated in FIG. 9, the second opening 37 is circle-shaped. The second opening and the first opening have the same size and shape. The centers of the first and second openings are located coaxially. A fixed contact pad 25 is disposed in the center of the second opening 37. Four second extending parts 30*a* of the upper insulating resin sheet 30 are projected toward the fixed contact pad 25 in the second opening 37. Each of the second extending parts 30*a* is disposed in a diagonal line. However, the second extending parts 30*a* do not face the first extending parts 31*a*. That is, analogizing the layout of the four second extending parts 30*a* to four positions of the hour hand of a watch, they are disposed at 1:30AM, 4:30AM, 7:30AM, 10:30AM. Each of the four second extending parts 30*a* has a certain width, and each of the four second extending parts 30*a* has the same width. Each of the second four extending parts 30*a* is printed on the lower flexible sheet 20. The material of each second extending part 30*a* is the same as that of the lower insulating resin sheet 30. Thus, each second extending part 30*a* and the lower insulating resin sheet 30 are printed on the lower flexible sheet 20 simultaneously.

Figure 10:
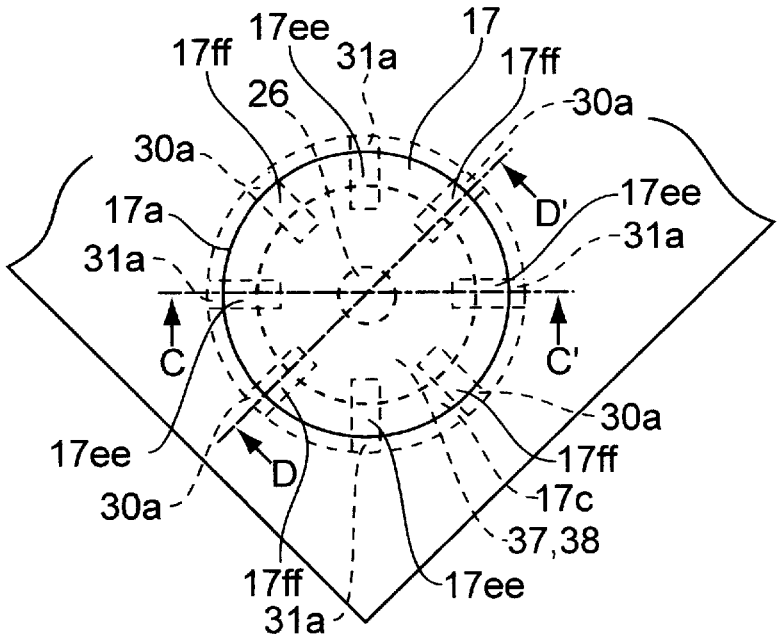
FIG. 10 is a partial plan view of the key switch of the second embodiment.

Referring to FIG. 10, according to the layout of the first and second extending parts 31*a*, 30*a*, when the membrane contact sheet 34 is formed, the first and second extending parts 31*a*, 30*a* are disposed alternately between the flexible sheets 20, 21.

Figure 11:
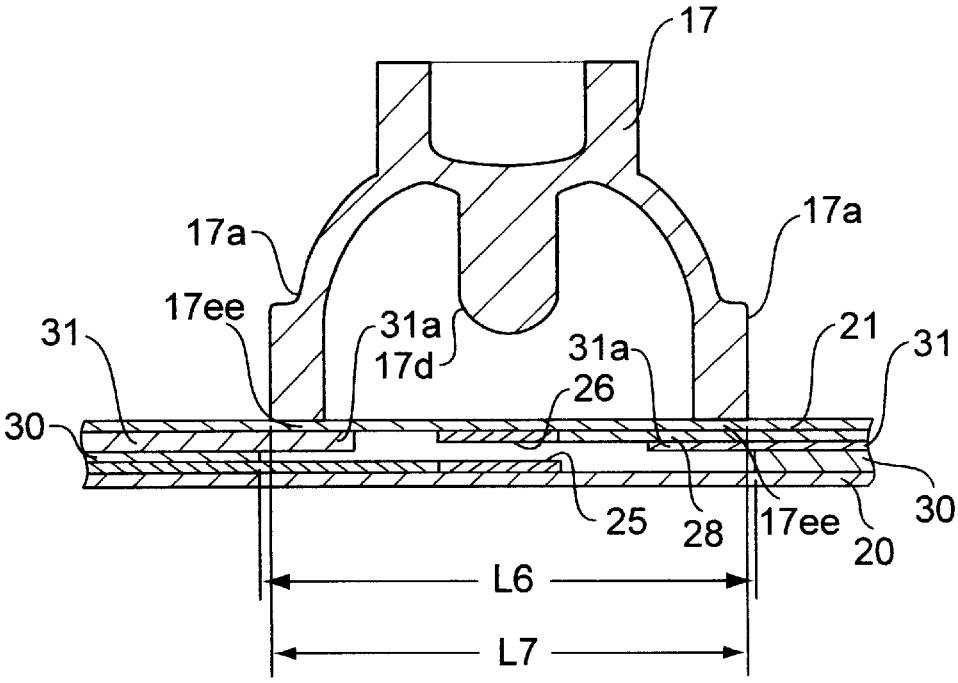
FIG. 11 is a cross-sectional view taken along line C—C' of FIG. 10.
Figure 12:
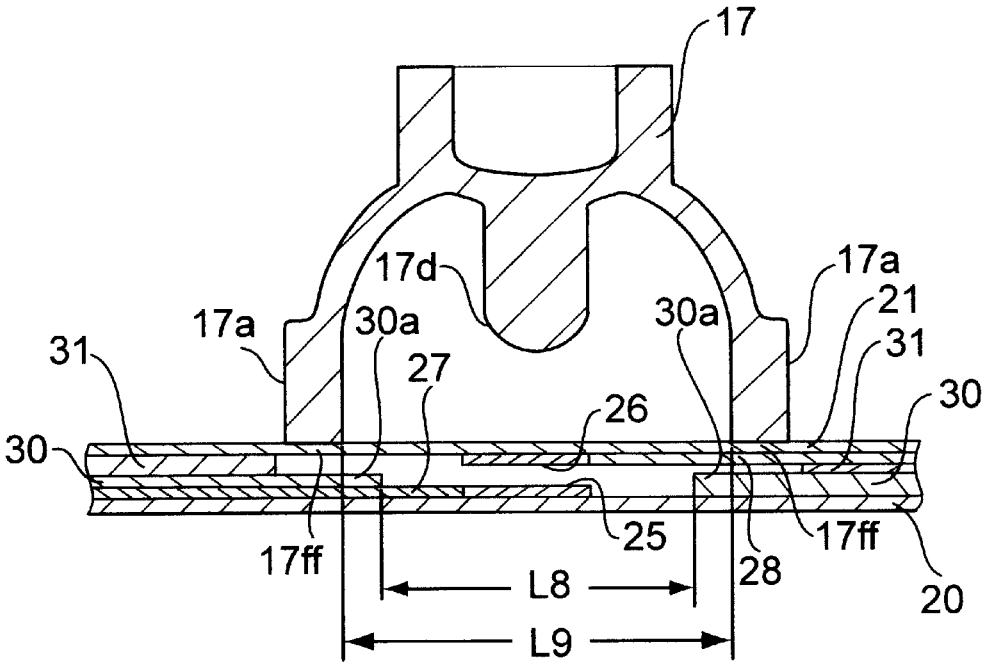
FIG. 12 is a cross-sectional view taken along line D—D' of FIG. 10.

Referring to FIGS. 10, 11 and 12, a diameter L6 of each of the first and second openings 38, 37 is longer than the external diameter L7 of the circular open end 17*b* of the elastic member 17(FIG. 11). Further, the distance L8 between the second external parts 30*a*, which face each other, is shorter than the internal diameter L9 of the circular open end 17*b* of the elastic member 17 (FIG. 12). Moreover, the distance between the first external parts 31*a*, which face each other, is also shorter than the internal diameter L9 of the circular open end 17*b* of the elastic member 17. Thus, as shown in FIG. 10, in an area 17*ee*, the upper flexible sheet 21 and the first extending parts 31*a* are under the circular open end 17*b*, and in an area 17*ff*, the upper flexible sheet 21 and the second extending parts 30*a* are under the circular open end 17*b*.

Figure 13:
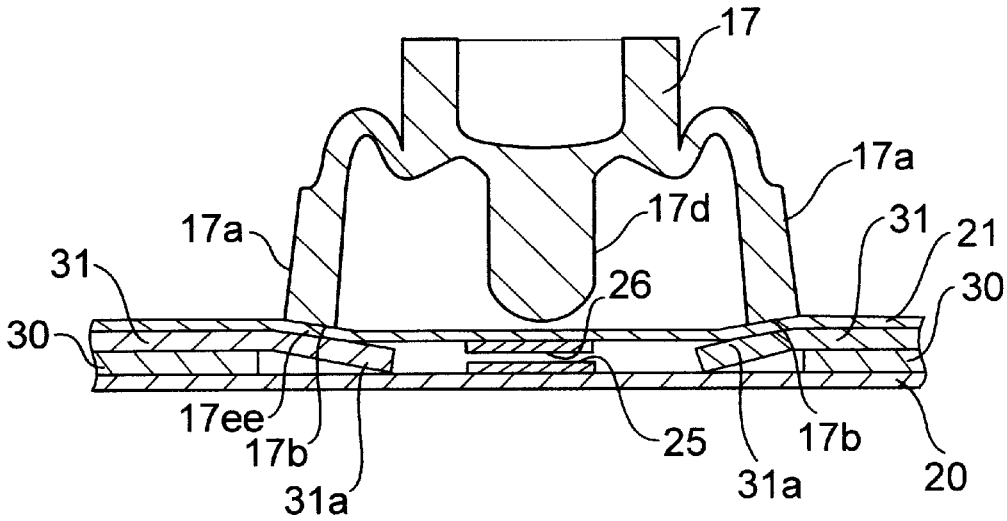
FIG. 13 is a cross-sectional view taken along line C—C' of FIG. 10, which shows one of the operation processes of the key switch of the second embodiment.
Figure 14:
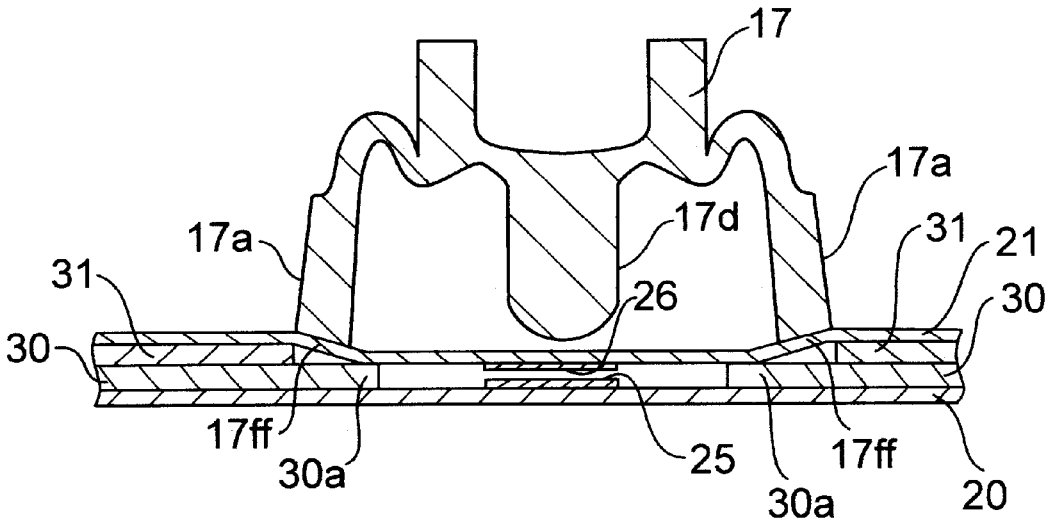
FIG. 14 is a cross-sectional view taken along line D—D' of FIG. 10, which shows the one of operation processes of the key switch of the second embodiment.

Next, the operation of the key switch is explained in detail with reference to FIGS. 13 and 14. When the key top 16 of the key switch 29 shown in FIG. 11 is pushed down by the operator, the relatively thin part of the bell-shaped spring leg part 17*a* begins to deform. Then, as shown in FIG. 13, when the operator pushes the key top 16 further, the tip of the first extending part 31*a* contacts the lower flexible sheet 20. At the same time, as shown in FIG. 14, the tip of the second extending part 30*a* contacts the upper flexible sheet 21. Under these circumstances, the moveable contact pad 26 does not yet contact with the fixed contact pad 25.

When the key top 16 of the key switch 29 is further pushed down by the operator, the relatively thin part of the bell-shaped spring leg part 17*a* and the upper flexible sheet 21 are further deformed. As a result, the top of the contact depression part 17*d* reaches the upper flexible sheet 21 Then, when the contact depression part 17*d* pushes the upper flexible sheet 21 further, the first and second extending parts 31*a*, 30*a* are compressed. As a result, the moveable contact pad 26 reaches the fixed contact pad 25 so that the moveable contact pad 26 is electrically connected to the fixed contact pad 25. Thus, the key switch 29 is closed. When the key top 16 is released, the key top 16 returns to the original position by the memory of the elastic member 17, and the upper flexible sheet 21 and the first extending parts 31*a* return to the original shape by the memory of the upper flexible sheet 21. As a result, the contacting pads 25, 26 are separated so that the key switch 29 is opened.

In the key switch operation, before the moveable contact pad 26 reaches the fixed contact pad 25, the first extending part 31*a* contacts the lower flexible sheet 20 and the second extending part 30*a* contacts the upper flexible sheet 21. In this state, the moveable contact pad 26 does not approach the fixed contact pad 25 by the weight of the elastic member 17. Thus, it is possible to avoid malfunction by contacting the moveable contact pad 26 with the fixed contact pad 25. Further, the subsequent large force is not required to make the moveable contact pad 26 contact with the fixed contact pad 25. Moreover, when the first extending part 31*a* contacts the lower flexible sheet 20 and the second extending part 30*a* contacts the upper flexible sheet 21, the distance between the moveable contact pad 26 and the fixed contact pad 25 is determined by the thickness of the first and second extending parts 31*a*, 30*a*, and the distance of the first and second extending parts 31*a*, 30*a*. Thus, when all key switches of the key board use the upper and lower flexible sheets 21, 20 having the same thickness and the first and second extending parts 31*a*, 30*a* having the same thickness and length, then a constant distance between the moveable contact pad 26 and the fixed contact pad 25 can be secured when the first extending part 31*a* contacts the lower flexible sheet 20 and the second extending part 30*a*contacts the upper flexible sheet 21. Therefore, the operator can push the key top 16 down with the constant force to make the moveable contact pad 26 contact the fixed contact pad 25.

These benefits described above are embodied by disposing the open end 17*b* of the elastic member 17 inside the first and second openings 38, 37. Therefore, it is possible to have a wide margin or error when the key switch is assembled. In other words, it is possible to lax the accuracy of the assembly of the key switch 29.

As described above, according to the second embodiment, since it is possible to reduce the force to push the key top 16 down to make contact between the moveable contact pad 26 and the fixed contact pad 25, the diameters of the first and second openings 38, 37 can be reduced. Thus, in conformity to the reduced openings, the size of the elastic member 17 also can be reduced. As a result, the key switch can be downsized.

Further, according to the second embodiment, since the open end 17*b* of the elastic member 17 is simply disposed on the upper flexible sheet 21 under which the first and second extending parts 31*a*, 30*a* are formed, it is not necessary to form the relatively large elastic member 17 in anticipation of a printing misalignment of the insulating resin sheets 31, 30 or a misalignment during assembly of the elastic member 17. In view of this benefit, the key switch can be downsized.

Moreover, as well as the benefits of the first embodiment, the second embodiment has the benefit that when the center of the key top 16 is misaligned to the center of the contact pads 25, 26 because of a misprinting of the insulating resin sheets 30,31 or a misassembly of the elastic member 17, it is not required to push the key top 16 down with a large force in order to obtain contact between the contact pads 25, 26. Thus, it is possible to form key switches with less or fewer contacting defects, without using high-precision manufacturing processes. As a result, it is possible to reduce the cost of a mold to manufacture the key switch.

According to the second embodiment, the first and second extending parts 31*a*, 30*a* are formed. However, either the first extending parts 31*a* or the second extending parts 30*a* may be formed. In such a case, a single insulating resin sheet may be formed in stead of the dual insulating resin sheets. Further, in the second embodiment, four first extending parts 31*a* and four second extending parts 30*a* are formed. However, the number of the first and second extending parts are not limited to four. When the number of each of the first and second extending parts is reduced, the width of the each extending part may be wider. When the number of each of the first and second extending parts is increased, the width of the each extending part may be narrower. That is, under the state that the total area of the area 17*ee* and the total area 17*ff* should be a constant in any numbers of the first and second extending parts, the force to push the key top 16 to make the contact pads 25, 26 contact may be a constant.

Moreover, the openings 36, 37 are circular-shaped in the second embodiment. However, any shapes of the opening can be formed if first and second extending parts are formed under the open end 17*b* of the elastic member 17. But, if the shapes of the open end 17*b* and the openings 38, 37 are the same, the key switch 29 can be downsized more because it is not necessary to form the margin for the openings.

While the present invention has been described with reference to illustrative embodiments, this description is not intended to be construed in a limiting sense. Various other modifications of the illustrated embodiments, as well as other embodiments of the invention, will be apparent to those skilled in the art on reference to this description. Therefore, the appended claims are intended to cover any such modifications or embodiments as fall within the true scope of the invention.

We claim:

1. A key switch, comprising a first sheet having a fixed contact pad;

a second sheet having a moveable contact pad that faces the fixed contact pad;

a film sandwiched between the first and second sheets, the film having an opening, which is located at the moveable and fixed contact pads; and an elastic member having a bell-shaped leg part and a contact depression part to contact the second sheet when pushed down, the elastic member being placed on the second sheet, and being disposed above the opening, wherein a part of a bottom face of the bell-shaped leg part faces the opening, and another part of the bottom face faces the film.

2. A key switch as claimed in claim 1, wherein the opening is polygon-shaped, wherein a corner of the opening is extended to outside of an internal wall of the bell-shaped leg and wherein a middle of a side of the opening is located inside of the internal wall of the bell-shaped leg.

3. A key switch as claimed in claim 2, further comprising a key top formed on the elastic member, wherein a distance between a center of the moveable contact pad and the middle of the side of the opening is determined so as to make a force pushing the key top constant, based on a distance between the fixed and moveable contact pads in a state that the key top is not pushed.

4. A key switch as claimed in claim 1, further comprising, a key top formed on the elastic member; and a plurality of extending parts projecting from the film toward a center of the opening.

5. A key switch as claimed in claim 4, wherein the film includes a first resin sheet and a second resin sheet, which is coupled to the first resin sheet, wherein the extending parts are first extending parts, and wherein the first extending parts project from the first resin sheet, the key switch further comprising a plurality of second extending parts, which project from the second resin sheet, wherein the first and second extending parts are disposed alternatively.

6. A key switch as claimed in claim 5, wherein the first extending parts contact the first sheet before the movable contact pad contacts the fixed contact pad when the key top is pushed down.

7. A key switch as claimed in claim 4, wherein the film is a first film, and the opening is a first opening, the key switch further comprising a second film having a second opening, the second opening having the same size and the same shape as the first opening, the centers of the first and second openings are located coaxially, and the second film is sandwiched between the first and second sheets.

8. A key switch as claimed in claim 7, wherein the first extending parts contact the first sheet before the movable contact pad contacts the fixed contact pad when the key top is pushed down.

9. A key switch, comprising:

a key top;

an elastic member including a top part disposed under the key top, a bell-shaped spring leg having a circular open end, and a contact depression part located inside the bell-shaped spring leg;

a first sheet, the first sheet including a top surface and a back surface, and the elastic member being placed on the top surface;

a moveable contact pad formed on the back surface of the first sheet, the moveable contact pad being located at the center of the circular open end;

a second sheet;

a fixed contact pad formed on the second sheet, the fixed contact pad facing the moveable contact pad; and an insulating resin sheet sandwiched between the first and second sheets, the insulating resin sheet having an opening, the opening having a shape different from that of the circular open end of the bell-shaped spring leg, a shortest distance between a center of the opening and a periphery of the opening being shorter than half of an inside diameter of the circular open end, and a longest distance between the center of the opening and the periphery of the opening being longer than half of the inside diameter of the circular open end.

10. A key switch as claimed in claim 9, wherein the opening is polygonal.

11. A key switch as claimed in claim 9, wherein the opening is square-shaped.

12. A key switch as claimed in claim 9, wherein the insulating resin sheet is a first insulating resin sheet which is formed on the back surface of the first sheet and the opening is a first opening, the key switch further comprising a second insulating resin sheet having a second opening, which has a same shape and the same size as the first opening, and the centers of the first and second opening are located coaxially.

13. A key switch, comprising:

a key top;

an elastic member including a top part disposed under the key top, a bell-shaped spring leg having a circular open end, and a contact depression part located inside the bell-shaped spring leg;

a first sheet, the first sheet including a top surface and a back surface, and the elastic member being placed on the top surface;

a moveable contact pad formed on the back surface of the first sheet, the moveable contact pad being located at the center of the circular open end;

a second sheet;

a fixed contact pad formed on the second sheet, the fixed contact pad facing the moveable contact pad; and a first insulating resin sheet formed on the back surface of the first sheet, the first insulating resin sheet having a first circle-shaped opening whose diameter equals an external diameter of the circular open end of the bell-shaped spring leg;

a second insulating resin sheet formed on the second sheet, the second insulating resin sheet including a second circle-shaped opening, which has a same size as the first circle-shaped opening, the centers of the first and second opening being located coaxially;

a plurality of first extending parts projecting from the first insulating resin sheet toward the center of the first opening; and a plurality of second extending parts projecting from the second insulating resin sheet toward the center of the second opening, wherein the first and second insulating resin sheets and the first and second extending parts are sandwiched between the first and second sheets.

14. A key switch as claimed in claim 13, wherein the first and second extending parts are disposed alternatively.

* * * * *